United States Patent [19]

Stemmler

[11] Patent Number: 5,067,698

[45] Date of Patent: Nov. 26, 1991

[54] METHOD AND APPARATUS FOR MANUFACTURING INTERFOLDED TOWELING

[75] Inventor: Kurt Stemmler, Neuwied, Fed. Rep. of Germany

[73] Assignee: Winkler & Dunnebier Maschinenfabrik und Eisengiesserei KG, Neuwied, Fed. Rep. of Germany

[21] Appl. No.: 404,845

[22] Filed: Sep. 8, 1989

[30] Foreign Application Priority Data

Sep. 26, 1988 [DE] Fed. Rep. of Germany ..... 3832595

[51] Int. Cl.[5] ..... B41L 1/32

[52] U.S. Cl. ..... 270/39; 270/21.1

[58] Field of Search ..... 270/39, 45, 47, 48, 270/21.1

[56] References Cited

U.S. PATENT DOCUMENTS

| | | | |
|---|---|---|---|
| 2,467,977 | 4/1949 | Jones | 270/39 |
| 3,489,406 | 1/1970 | Nystrand | 270/39 |
| 4,163,548 | 8/1979 | Nystrand | 270/39 |
| 4,279,411 | 7/1981 | Nystrand | 270/39 |
| 4,717,135 | 1/1988 | Hathaway | 270/39 |

*Primary Examiner*—Edward K. Look
*Assistant Examiner*—Therese M. Newholm
*Attorney, Agent, or Firm*—Collard, Roe & Galgano

[57] ABSTRACT

A method and apparatus is provided for manufacturing toweling interfolded in a zigzag manner, particularly partially overlapping, interfolded toweling folded "n" times. The method includes alternatingly cutting sections of toweling of equal length from a first continuously advancing web of material and from a second continuously advancing web of material, separating each of the cut sections of toweling in the direction of advancement to a specified length by extraction devices, reconducting together each of the cut sections of toweling and with a staggering device ordering a first sequence such that the cut sections of toweling have an overlap which is adjustable and equal, continuously folding with a pair of counter rotating folding rollers the first sequence of cut sections of toweling in a zigzag manner to a second sequence, and forming the second sequence of cut toweling folded in a zigzag manner into a folded stack.

21 Claims, 3 Drawing Sheets

METHOD AND APPARATUS FOR MANUFACTURING INTERFOLDED TOWELING

The present invention relates generally to a method and apparatus for manufacturing interfolded toweling and, more particularly, to a method and apparatus for manufacturing toweling interfolded in a zigzag manner.

Interfolders are used in the manufacture of toweling interfolded in a zigzag manner as, for example, facial towels, toilet paper, hand towels made from paper, tissue or similar material. The material to be processed is fed in the form of a web which is cut into individual segments of toweling and thereupon by means of counter-rotating folding rollers interfolded in a zigzag manner. The interfolded segments of toweling thereupon exit the folding rollers in the form of a continuous stack, which is later separated into individual stacks of equally numbered sheets. Finally, these individual stacks are packed in dispenser boxes which are uniform in width.

In their most elementary and also most prevalent execution, these individual sheets have only one folded edge and possess a length which is determined by the dimensions of the dispensing box and corresponds to twice the width of the standard dispenser box. Experience, however, has shown that single ply sheets are a little too small for effective utilization. Because of this, the need has arisen for larger sheets having a greater number of folded edges per segment. In order to achieve optimum removal of the individual sheets from the dispenser box, the individual sheets may only overlap each other, respectively, up to their first folded edge. This is intended to ensure that the respective individual sheet does not hang too far out of the pullout opening of the dispenser box. It has only heretofore been possible, with the interfolders currently available on the market, to manufacture segmented toweling having an uneven number "n" of folded edges, which results in a towel segment length of "n"+1 times the width of the dispenser box.

The optimal towel segment, which would be capable of satisfactorily filling the needs of the marketplace would, of course, be a sheet or segment having two folded edges. To date, however, there has been no interfolder available for the manufacture of such a towel segment having two folded edges.

Thus, the object of the present invention is to provide a method and an apparatus, such as an interfolder, to implement the method which enables segments of toweling to be manufactured which have an even number of folds per segment and which preferably overlap only to the first folded edge. It is also an object of the present invention to provide a method and apparatus for manufacturing, as has heretofore been possible, segmented toweling having an uneven number of folds.

The above objects are accomplished in accordance with the present invention by providing a method for manufacturing toweling interfolded in a zigzag manner, particularly partially overlapping, interfolded toweling folded "n" times by alternatingly cutting sections of toweling of equal length from a first continuously advancing web of material and from a second continuously advancing web of material, separating each of the cut sections of toweling in the direction of advancement to a specified length, reconducting together each of the cut sections of toweling in an ordered first sequence such that the cut sections of toweling have an overlap which is adjustable and equal, continuously folding the first sequence of cut sections of toweling in a zigzag manner to a second sequence, and forming the second sequence of cut toweling folded in a zigzag manner into a folded stack. The apparatus for carrying out this method is an interfolder which includes a first feeder means for continuously feeding the first web of material, a second feeder means for continuously feeding the second web of material, a first transverse cutting means for cutting sections of toweling of equal length from the first web of material, a second transverse cutting means for cutting sections of toweling of equal length from the second web of material, a first extraction means for separating the sections of toweling cut from the first web to a specified length in the direction of advancement, a second extraction means for separating the sections of toweling cut from the second web to a specified length in the direction of advancement, reconducting means for reconducting the sections of toweling cut from the first and second webs, staggering means for ordering the cut sections of toweling cut from the first and second webs in a first sequence having an equal and adjustable overlap, and a pair of counter rotating folding rollers and a packing track for continuously folding the cut sections of toweling of the first sequence in a zigzag manner into a folded stack.

The objects thus achieved by the present invention relate particularly to the fact that it is possible to selectively manufacture segmented toweling having either an even or an odd number of folds whereby the segments respectively overlap each other at a desired, adjustable length, preferably up to the first folded edge.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
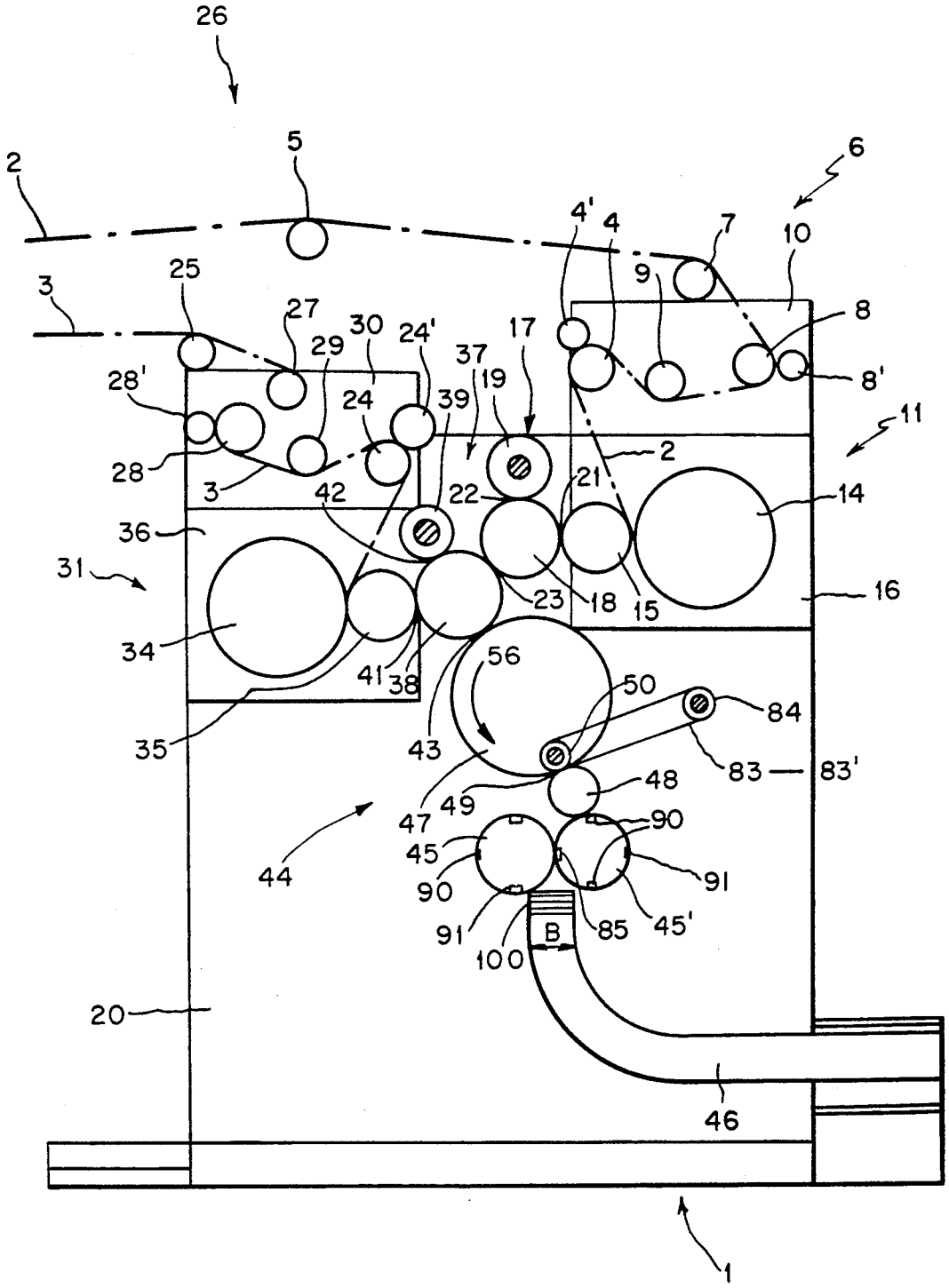
FIG. 1 is a schematic side elevational view of the interfolder according to the present invention.

A machine for manufacturing toweling interfolded in a zigzag manner essentially consists of a reel-off station, a processing section, hereinafter designated an interfolder, and repository with post-phase packing unit. FIG. 1 shows only the interfolder, generally designated 1, which is of consequence for the present invention. In order to manufacture partially overlapping, interfolded toweling folded "n" times, interfolder 1 is shown processing two continuous webs of material, designated 2 and 3.

Web 2 is drawn by means of an internally disposed pair of feed rollers 4 and 4' and, conducted by direction rollers 5, advanced to right feeder 6 of interfolder 1. Feeder 6, besides the pair of feed rollers 4 and 4', further includes a broad-drawing roller 7, a pair of embossing rollers 8 and 8', in addition to a direction roller 9. Rollers 4, 4', 7, 8, 8' and 9 are rotatably mounted in common backdrop walls 10. In feeder 6, web 2 is smoothed by means of broad drawing roller 7, receiving thereafter a marginal embossment from the pair of embossing rollers 8 and 8'. Direction roller 9 is arranged between the pair of embossing rollers 8 and 8' and the pair of feed rollers 4 and 4' in such a way that web 2 encircles feed roller 4 over a large circumfrential area. Web 2 is advanced by the pair of feed rollers 4 and 4' to a transverse cutting mechanism 11 where it is cut into individual towel segments 12. Transverse cutting mechanism 11 consists of format-dependent cutter block 14 and a counter roller 15 which are rotatably mounted in common backdrop walls 16. Depending on the format and layout, cutter block 14 can support one or more transverse cutting blades (not shown). Counter roller 15 has vacuum gripper devices (not shown) to further advance the cut towel segments 12, which vacuum gripper devices can be pressurized with vacuum. Cut towel segments 12 are advanced from counter roller 15 to an extraction mechanism 17 which is driven at a higher peripheral speed. Extraction mechanism 17 consists of an extraction roller 18 and a segment roller 19, acting together with the extraction roller, which are rotatably mounted in common main backdrop walls 20 of interfolder 1. In order to clamp or hold and advance towel segments 12, extraction roller 18 has vacuum gripper devices in the form of perforated strips (not shown) which are pressurized by means of a control valve (not shown) to low vacuum conditions from roller gap 21, formed by counter roller 15 and extraction roller 18, up to roller gap 22, formed by extraction roller 18 and segment roller 19, and thereafter pressurized to higher vacuum conditions up to roller gap 23, which is formed by extraction roller 18 and extraction roller 38.

During the separation operation, a towel segment 12 is fixed in position on counter roller 15 by means of vacuum and advanced thereafter at the peripheral speed of the counter roller until its downstream end 12' reaches roller gap 22. This is effected by maintaining the upstream end 12'' of towel segment 12 in a torsion-free position on counter roller 15, while the low-vacuum pressurized gripper devices of extraction roller 18 glide by the downstream end 12' of towel segment 12 only guiding said segment in an arc up to roller gap 22. When the downstream end 12' of towel segment 12 reaches roller gap 22, the vacuum gripper device of counter roller 15 is depressurized and towel segment 12, by means of segment roller 19 and the higher vacuum devices of extraction roller 18, is accelerated to the peripheral speed of extraction roller 18, whereby a desired distance to, or separation from, the following towel segment 12 results.

The web of material 3 is fed at the same rate of speed to interfolder 1 and further processed as described for web of material 2. In the process, web 3 is drawn by means of an internally disposed pair of feed rollers 24 and 24' and, conducted by direction rollers 25, advanced to a left feeder 26 of interfolder 1. Feeder 26, besides a pair of feed rollers 24 and 24', further includes a broad-drawing roller 27, a pair of embossing rollers 28 and 28', as well as a direction roller 29. Rollers 24, 24', 27, 28, 28' and 29 are rotatably mounted in common backdrop walls 30. In feeder 26, web 3 is smoothed by means of broad-drawing roller 27, receiving thereafter a marginal embossment from the pair of embossing rollers 28 and 28'. Direction roller 29 is arranged between the pair of embossing rollers 28 and 28' and the pair of feed rollers 24 and 24' in such a way that the web of material encircles feed roller 24 over a large circumfrential area. Web 3 is advanced by the pair of feed rollers 24 and 24' to a transverse cutting mechanism 31 where it is cut into individual towel segments 13. Transverse cutting mechanism 31 has the same dimensions as transverse cutting mechanism 11 and is driven at the same angular velocity and is, of course, offset in phase by 180° from transverse cutting mechanism 11. Transverse cutting mechanism 31 also consists of a format-dependent cutter block 34 and a counter roller 35 which are rotatably mounted in common backdrop walls 36. Depending on the format and layout, cutter block 34 can support one or more transverse separation blades (not shown). Counter roller 35 has vacuum gripper devices (not shown) to further advance cut towel segments 13, which gripper devices can be pressurized with vacuum. Towel segments 13 are advanced from counter roller 35 to an extraction mechanism 37 driven at a higher peripheral speed which is equal to that of extraction mechanism 17. Extraction mechanism 37 consists of an extraction roller 38 and a segment roller 39, acting together with the extraction roller, which are rotatably mounted in the main backdrop walls 20 of interfolder 1. In order to clamp or hold and advance towel segments 13, extraction roller 38 includes vacuum gripper devices in the form of perforated strips (not shown) which are pressurized by means of a control valve (not shown) to low vacuum conditions from roller gap 41, formed by counter roller 35 and extraction roller 38, up to roller gap 42, formed by extraction roller 38 and segment roller 39, and thereafter pressurized to higher vacuum conditions up to a roller gap 43 which is formed by extraction roller 38 and staggering roller 47. During the separation operation a towel segment 13 is fixed in position on counter roller 35 by means of vacuum and advanced thereafter at the peripheral speed of counter roller 35 until its downstream end 13' reaches roller gap 42. This is effected by maintaining the upstream end 13'' of the towel segment in a torsion-free position on the counter roller while the pressurized low vacuum gripper devices of extraction roller 38 glide by downstream end 13' of towel segment 13 only guiding said segment in an arc up to roller gap 42. When the downstream end 13' of the towel segment has reached roller gap 42, the vacuum gripper device of counter roller 35 is depressurized and towel segment 13, by means of segment roller 39 and the vacuum gripper devices of extraction roller 38 which have been pressurized to higher vacuum conditions, is accelerated to the peripheral speed of extraction roller 38, whereby a desired distance to, or separation from, the following towel segment 13 results.

Figure 4:
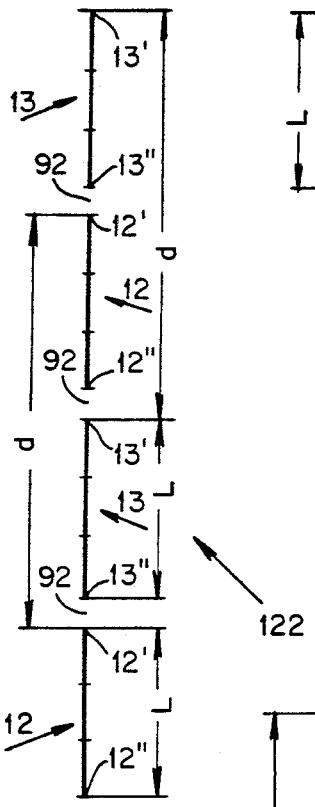
FIG. 4 shows segmented sheets of toweling which have been cut from two webs of material, separated from one another in the direction of transport and reconducted together to form the imbricated series shown in FIG. 5.

The distance generated by means of extraction mechanisms 17 and 37, measured from the downstream ends 12' or 13' of towel segments 12 and 13 to the corresponding ends of the following towel segments 12 and 13 is, when interfolded towel segments 12 and 13 with an even number of folds per segment are being manufactured, greater than double the length "L" of a towel segment, as clearly seen in FIG. 4. This same distance, when interfolded towel segments 12 and 13 with an odd number of folds per segment are being manufactured, is about 2 times $L_1$, which is the overlapping length, less than double the length "L" of a towel segment 12 or 13.

Figure 7:
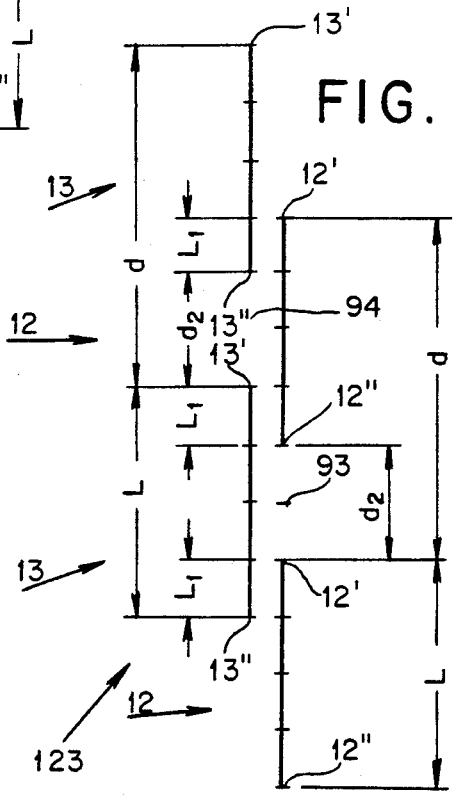
FIG. 7 shows an imbricated series of toweling with three folds per segment prior to folding.

In the execution described, extraction roller 38 serves at the same time as the reconducting roller for towel segments 12 and 13. Towel segments 12 are handed off by extraction roller 18 to extraction roller 38 in such a way that, on the latter, a sequence 122 or 123 (see, FIGS. 4 and 7) results in which the towel segments 12 vis-a-vis those towel segments 13, are dephased by one half the cadence interval prevailing at this location, depending on the towel format selected. In the manufacture of interfolded towel segments 12 and 13 having an even number of folds per segment, a sequence 122, as FIG. 4 shows, results in which, without overlapping, each towel segment 12 is followed by another segment 13. In the manufacture of interfolded towel segments 12 and 13 having an odd number of folds per segment, in contrast, a sequence 123, as illustrated in FIG. 7, results in which, respectively, one segment 12 is laid down on two towel segments 13 in such a way that it overlaps segments 13 by the same length $L_1$. The sequence 122 or 123 is turned over to a staggering mechanism 44 by extraction roller 38.

Figure 5:
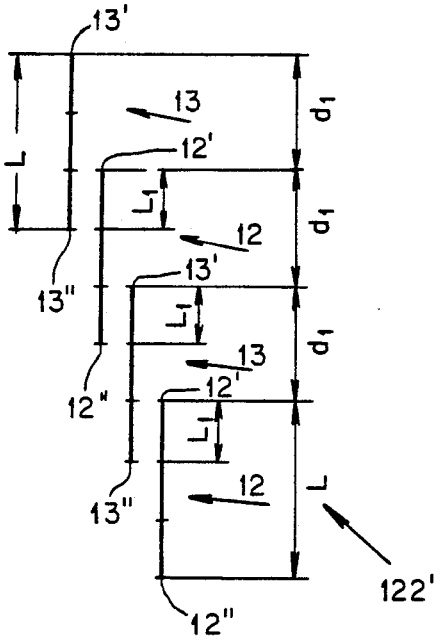
FIG. 5 shows an imbricated sequence of toweling with two folds per segment prior to folding.
Figure 6:
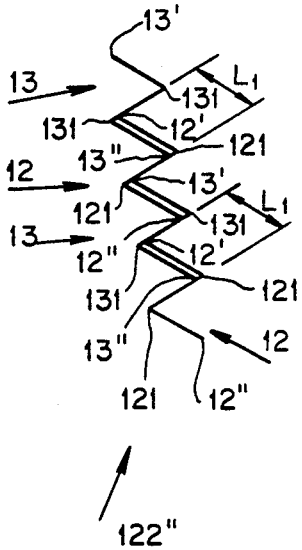
FIG. 6 shows the folded state of the series of toweling shown in FIG. 5.
Figure 8:
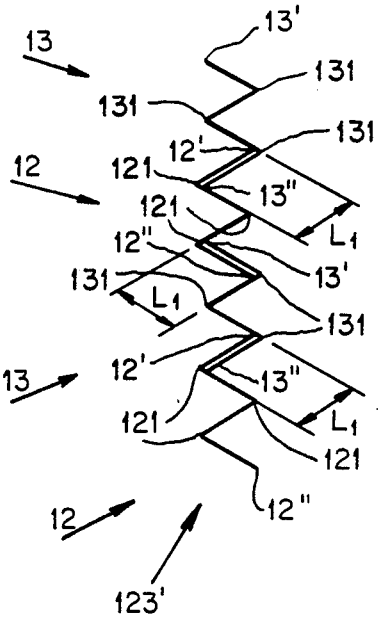
FIG. 8 shows the folded state of the series of toweling shown in FIG. 7.

Towel segments 12 and 13 of sequence 122, as seen in FIG. 5, are staggered at a short cadence interval. In the process, the downstream ends 12' and 13' of towel segments 12 and 13 are conducted under the upstream ends 12" and 13" of the respective downstream adjacent towel segment, such that an imbricated series 122' is produced. The sequence 123, on the other hand, is not modified in staggering mechanism 44. Sequence 122' or 123 is thereupon fed to a pair of counter rotating folding rollers 45 and 45' by means of which it is continuously folded in zigzag manner to a series 122", 123', as shown in FIGS. 6 and 8, which series is conveyed along a packing track to form a stack 100.

Figure 2:
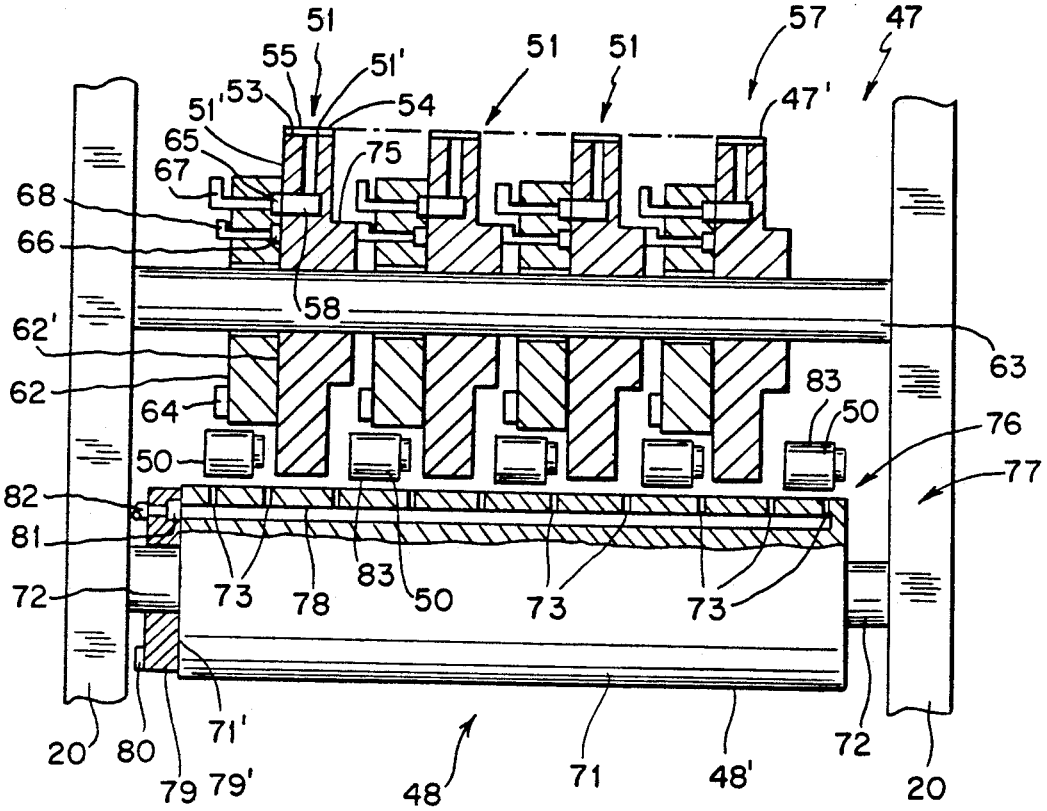
FIG. 2 is a partial cross-sectional front view of the staggering device of the interfolder of FIG. 1.
Figure 3:
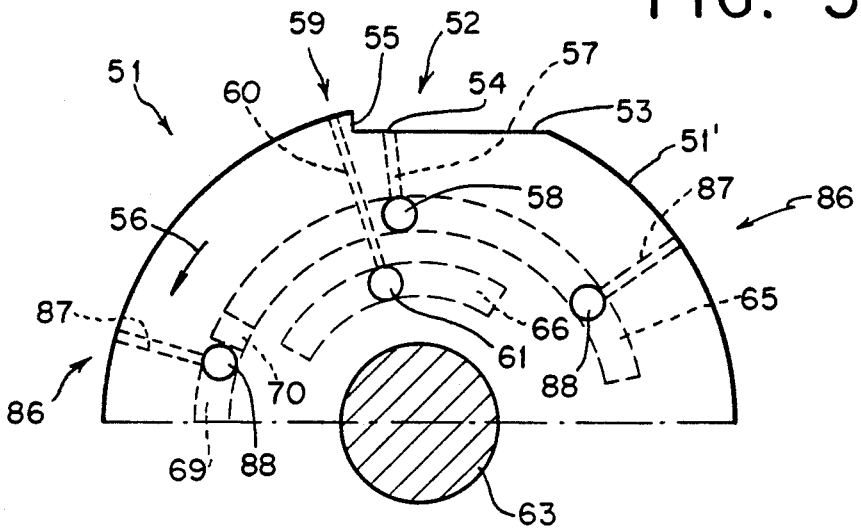
FIG. 3 is a partial side view of a staggering disc of the staggering device shown in FIG. 2.

Staggering mechanism 44 consists essentially, as shown in FIGS. 1 and 2, of a staggering roller 47, a counter roller 48, and several staggering cylinders 50. While staggering roller 47 and counter roller 48 are rotatably mounted in common main backdrop walls 20 and, with outer lining 47' of staggering roller 47, form a common, parallel roller gap 49, staggering cylinders 50 are arranged on separate fixtures (not shown) by means of which they are elastically positioned in roller gap 49 yet pivotable with respect to counter roller 48. Staggering cylinders 50 extend into the periphery of staggering roller 47. For this reason, staggering roller 47 is constructed of several identical staggering discs 51, which are located coaxially and in a torsion-free position on a common shaft 63, forming outer lining 47'. Staggering disc 51 is, as illustrated in FIGS. 2 and 3, wheel-shaped, with a hub 75 on its right side. To grasp and hold towel segments 12 and 13, each staggering disc 51 is equipped with a vacuum gripper device 52 which is arranged in a flat segment 53 of outer casing 51' of disc 51 in the form of a vacuum aperture 54. Flat segment 53 terminates in the direction of rotation 56 of staggering roller 47 at a gradation 55. All staggering discs 51 are aligned parallel to shaft 63. Vacuum aperture 54, serving as an air conduit, is connected by means of radial bore 57, to blind bore 58 which is open toward the left side 51" of staggering disc 51. In the direction of rotation 56 prior to gradation 55, a compressed air jet 59 is arranged on outer casing 51' and serves as an air conduit, connected via a radial bore 60 to an axial blind bore 61. A control valve 62 for vacuum and compressed air is located on the front side on the side 51" of disc 51 and is held in torsion-free position vis-a-vis backdrop walls 20 by mean of a fixture 64 while it is connected to shaft 63 in a freely rotating manner, on which axis it is prevented from axial displacement by means not illustrated. Radially arranged on a side 62' of control valve 62 which faces side 51" of disc 51 and at the same distance to shaft 63 there is a duct 65 for vacuum and a duct 69 for equalization of atmospheric pressure. Further inside there is an additional radial duct 66 for compressed air. While duct 65 is connected via a feeder conduit 67 to a vacuum source (not shown), duct 66, via feeder conduit 68, is connected to a source of compressed air (not shown). During operation, blind bore 58 of disc 51 rotates past ducts 65 and 69. In order to grasp and hold towel segments 12 and 13 in roller gap 43, at which point the segments come to rest with their downstream ends 12' and 13' on the gradation 55, vacuum gripper device 52 is pressurized with vacuum. In handing off towel segments 12 and 13 in roller gap 49, on the other hand, vacuum gripper device 52 is charged with compressed air. In order to adjust the time at which the segments are handed off, ducts 65 and 69 are separated by means of a displaceable block 70. Blind bore 61 of disc 51 meanwhile rotates past duct 66 of control valve 62, and compressed air jet 59 is thereupon charged with compressed air, blowing the downstream ends 12" and 13" of towel segments 12 and 13 immediately preceding it away from outer lining 47'. Through utilization of controlled compressed air, in conjunction with the vacuum applied at downstream ends 12' and 13' of the towel segments to lower lying flat segments 53, downstream ends 12' and 13' can, with no difficulty, be made to slide under the ends 12" and 13" of the towel segment immediately preceding it during the overlapping operation with a given sequence.

Counter roller 48 and, consequently, staggering cylinders 50, as well, are positioned with respect to staggering roller 47 in such a way that the interval between roller gaps 43 and 49, measured in circular measurement on the outer lining 47' of staggering roller 47 is substantially larger than the longest format of a towel segment. The geometric configuration of counter roller 48 in the direction of rotation 56 behind the lowest point of staggering wheel 47 helps additionally, during the overlapping operation of sequence 122, to keep upstream ends 12" and 13" of the towel segments away from outer lining 47' of roller 47. In so doing, towel segments 12 and 13 are flattened out in the lower section of the staggering roller 47 and come to rest on a guide plate 74 maintained in tangential position with respect to staggering roller 47.

Counter roller 48 consists of a roller body 71 which is mounted in a torsion-free position on a shaft 72 and which defines an outer lining 48'. To grasp and hold towel segments 12 and 13, counter roller 48 is equipped with vacuum gripper devices 76 which are arranged on the outer lining 48' of roller 48 in rows 77 which are parallel to shaft 72, whereby the distance between the rows corresponds to the width "B" of stack 100. Vacuum bores 73, serving as conduits, are connected axially to blind bores 78 arranged in roller body 71 of counter roller 48. Blind bore 78 is open toward side 71' of roller body 71 where a control valve 79 for vacuum is arranged on shaft 72 on the front side of side 71'. Control valve 79 is held in torsion-free position vis-a-vis main backdrop walls 20 by means of fixture 80 while it is connected to shaft 72 in a freely rotating manner, on which axis it is prevented from axial displacement by means not illustrated. Radially arranged on side 79' of control valve 79 which faces side 71' of roller body 71 is a duct 81 for vacuum which, serving as a conduit, is connected via a feeder conduit 82 to a source of vacuum (not shown) and a duct for equalization of atmospheric pressure (not shown). The ducts are arranged at the same distance to shaft 72 as blind bore 78. During operation, blind bore 78 rotates past duct 81 for vacuum and past the duct for compressed air. In order to grasp and hand off towel segments 12 and 13, vacuum gripper devices 76 are, in alternating fashion, pressurized with vacuum and with compressed air. The mode of operation of the vacuum gripper devices and their mode of supply described for counter roller 48 similarly applies to all rollers of interfolder 1 which are outfitted with vacuum gripper devices and shall not, therefore, be described in any further detail.

As can be inferred from FIGS. 1 and 2, staggering cylinders 50 are driven at the speed of the counter roller 48. To this end, each staggering cylinder 50 is encircled by a drive belt 83 whose back side 83' serves as a graduated surface. All drive belts 83 receive, in turn, their motive power from a common drive shaft 84.

The sequence 122' and 123 are fed from counter roller 48 to a pair of folding rollers 45 and 45' which are rotatably mounted in main backdrop walls 20 and form a common roller gap 85. Additionally, each folding roller 45 and 45' is outfitted with two preliminary separation blades 90 and two flexible anvils 91, whereby anvils 91 have vacuum gripper devices (not shown). Preliminary separation blades 90 and anvils 91 are arranged, respectively, at a 90° off-set position on folding rollers 45 and 45' and folding roller 45, in the phase angle, is off-set with respect to folding roller 45' in such a way that, in alternating fashion, a folding blade 90 of folding roller 45 interacts with an anvil 91 of folding roller 45', as does a folding blade 90 of folding roller 45' interacts with an anvil 91 of folding roller 45. In this way, in alternating fashion, folded edges 121 and 131 are imparted to sequence 122' and 123 on the front and back side in roller gap 85, vacuum is applied to the sequence behind these edges and thereafter, as sequence 122'' and 123', are advanced on a packing track and deposited, a stack 100 is formed.

To further advance a sequence 123, additional switchable vacuum gripper devices 86 are provided on casing 51' of staggering discs 51. These discs exhibit, in relation to themselves and to vacuum gripper device 52, a distance which corresponds to the width "B" of stack 100. Each vacuum gripper device 86, serving as a conduit, can be connected via a radial bore 87 and an axial bore 88 to ducts 65 and 69. These additional vacuum gripper devices 86 prevent relative displacements between towel segments 12 and 13 from occurring during the continued advance of sequence 123 along outer lining 47' of staggering roller 47. During the processing of a sequence 123, it is also important that compressed air jets 59 and staggering roller 47, counter roller 48, staggering cylinders 50 and folding rollers 45, 45' be driven at the peripheral speed of extraction rollers 18 and 38.

It is obvious that rollers 8, 8', 28, 28', 4, 4', 24, 24', 14, 15, 34, 35, 18, 47, 48, 45, 45', 19 and 39, as well as the staggering cylinders 50 are driven in accordance with their function and the towel formats to be manufactured. For this purpose they are drive-connected to reduction gears and transmission gears which, however, because they are of no inventive relevance, have not been incorporated into the drawing or the present description.

In closing, the differences inherent in the manufacturing process of towel segments 12 and 13 interfolded in zigzag fashion with an even number or odd number of folds and folded edges 121 and 131 per segment of toweling 12 and 13 should, on the basis of FIGS. 4 through 8, be exemplified, taking into consideration the fact that, with a towel segment length "L" and "n" folds per towel segment, 12 and 13, adjacent towel segments 12 and 13, respectively, with a length $$L_1 = \frac{L}{n+1}$$

mutually overlap. This means that adjacent towel segments 12 and 13 overlap by the length $L_1$ from their ends 12', 12'', 13', 13''.

FIGS. 4 through 6 depict essential features of the manufacture of towel segments 12 and 13 interfolded in zigzag manner and having two folds and two folded edges 121 and 131 per segment which features, by way of substitution, are characteristic of the manufacture of towel segments 12 and 13 having an even number of folds per towel segment 12 and 13. Towel segments 12, having a length "L" are continuously detached from web 2 and pulled out or separated from each other in the direction of transport to a distance "d" measured from the front end 12' of one towel segment to the front end 12' of a towel segment immediately following, which distance is greater than 2 L. Dephased by half a machine cadence, towel segments 13 having a length "L" are continuously detached from web of material 3 and pulled out to a distance "d" which is also greater than 2 L. Towel segments 12 and 13 are thereupon reconducted together in such a way that, as FIG. 4 illustrates, a sequence 122 is produced in which one segment of toweling 13 follows each other segment of toweling 12 and vice-versa and whereby uniform gaps 92 are created between adjacent segments of toweling 12 and 13. Towel segments 12 and 13 are thereupon staggered to a distance "$d_1$" with the result that a sequence 122', as shown in FIG. 5, is produced. To accomplish this, downstream ends 12' and 13' of a towel segment are conducted under upstream ends 12'' and 13'' of the towel segment immediately preceding it. Towel segments 12 and 13 thereupon overlap each other at both ends 12', 12'', 13', 13'' by a third of their length "L". Subsequent thereto, sequence 122' is folded in such a way that a sequence 122'' is produced, forming a stack 100 in which the ends 12', 12'', 13', 13'' of towel segments 12 and 13, respectively, come to rest in the first folded edges 121 and 131 of adjacent towel segments 12 and 13, when viewed from the ends 12', 12'', 13', 13''.

FIGS. 7 and 8 depict essential features of the manufacture of towel segments 12 and 13 interfolded in zigzag manner and having three folds and three folded edges 121 and 131 per segment which features, by way of substitution, are characteristic of the manufacture of towel segments 12 and 13 having an uneven number of folds per towel segment. Towel segments 12, having a length of "L", are continuously detached from web 2 and pulled out, or separated from each other, in the direction of transport, such that between the adjacent towel segments 12 a space 93 where $$d_2 = L - \frac{2L}{n+1}$$

is created. Dephased by half a machine cadence, towel segments 13, having a length "L" are continuously detached from web 3 and pulled out, or separated, from each other in the direction of transport such that between adjacent towel segments 13 a space 94 where $$d_2 = L - \frac{2L}{n+1}$$

is created. Towel segments 12 and 13 are thereupon reconducted together in such a way that, as FIG. 7 illustrates, a sequence 123 is created in which a towel segment 12 is deposited on each space 94 created by adjacent towel segments 13 with the result that adjacent towel segments 13, respectively, are overlapped by the length $$L_1 = \frac{L}{n+1}.$$

Thereafter, sequence 123 is folded in such a way that stack 100 is produced from sequence 123' in which the ends 12', 12'', 13', 13'' of towel segments 12 and 13, respectively, come to rest in the first folded edges 121 and 131 of adjacent towel segments 12 and 13, when viewed from the ends 12', 12'', 13', 13''. It is possible, as needs require, to vary considerably the length of overlap $L_1$ by means of corresponding adjustments to the extraction mechanisms 17 and 37 or to staggering mechanism 44.

While only a single embodiment of the present invention has been shown and described, it will be obvious that many changes and modifications may be made thereto without departing from the sphere and scope of the invention.

What is claimed is:

1. A method for manufacturing toweling interfolded in a zigzag manner particularly partially overlapping, interfolded toweling folded "n" times, wherein "n" is an even number or an odd number, by an interfolder having two counter rotating folding rollers, said method comprising:

choosing "n" either as an even number or as an odd number;

alternately cutting sections of toweling of equal length from a first continuously advancing web of material and from a second continuously advancing web of material;

separating by accelerating each of said cut sections of toweling in the direction of advancement to a specified length;

reconducting together each said cut sections of toweling in an ordered first sequence such that said cut sections of toweling having an overlap which is adjustable and equal;

continuously folding said first sequence of cut sections of toweling in a zigzag manner into a second sequence; and forming said second sequence of cut toweling folded in a zigzag manner into a folded stack.

2. The method according to claim 1, wherein the cut sections of toweling are ordered into said first sequence having an overlap of equal length by means of a time delay.

3. The method according to claim 2, wherein the toweling is folded an even number of "n" times, the cut sections of toweling are ordered into a imbricated sequence by said time delay.

4. The method according to claim 3, wherein the cut sections of toweling are delayed during the course of a curvilinear phase of operation.

5. The method according to claim 4, wherein the cut sections of toweling are delayed during the course of a circular phase of operation.

6. The method according to claim 1, wherein the toweling is folded an even number of "n" times, the cut sections of toweling from each of said first and second webs following cutting are separated in the direction of advancement a length which is measured between the downstream end of a cut section of toweling and the downstream end of the cut section of toweling immediately following, said length being greater than twice the length of a cut section of toweling and the cut sections of toweling from each of said first and second webs are reconducted together to a first sequence in which a cut section of toweling of said first web follows a cut section of toweling of said second web and, between bordering cut sections of toweling, intervals of equal size are formed.

7. The method according to claim 3, which further comprises raising the upstream end of a cut section of toweling with respect to the downstream end of a cut section of toweling which immediately follows.

8. An interfolder for manufacturing toweling from first and second continuously advancing webs of material, said toweling being folded in a zigzag manner, particularly overlapping, interfolded toweling folded "n" times, wherein "n" is an even number or an odd number, wherein sections of toweling of equal length are alternatively cut from said first and second webs of material, the cut sections are separated in the direction of advancement to a specified length and the cut sections of the first and second webs reconducted together in an ordered first sequence having an equal and adjustable overlap, the first sequence is continuously folded in a zigzag manner into a second sequence, and the second sequence formed into a folded stack, said interfolder comprising:

means for choosing "n" either as an even number or as an odd number;

a first feeder means for continuously feeding said first web of material;

a second feeder means for continuously feeding said second web of material;

a first transverse cutting means for cutting sections of toweling of equal length from said first web of material;

a second transverse cutting means for cutting sections of toweling of equal length from said second web of material;

a first extraction means for separating by accelerating said sections of toweling cut from said first web to a specified length in the direction of advancement;

a second extraction means for separating by accelerating said sections of toweling cut from said second web to a specified length in the direction of advancement;

reconducting means for reconducting the sections of toweling cut from said first and second webs;

staggering means for ordering said cut sections of toweling cut from said first and second webs in a first sequence having an equal and adjustable overlap; and a pair of counter rotating folding rollers and a packing track for continuously folding the cut sections of toweling of said first sequence in a zigzag manner into a folded stack.

9. An interfolder for manufacturing toweling from first and second continuously advancing webs of material, said toweling being folded in a zigzag manner, particularly overlapping, interfolded toweling folded "n" times, wherein sections of toweling of equal length are alternatingly cut from said first and second webs of material, the cut sections are separated in the direction of advancement to a specified length and the cut sections of the first and second webs reconducted together in an ordered first sequence having an equal and adjustable overlap, the first sequence is continuously folded in a zigzag manner to a second sequence, and the second sequence formed into a folded stack, said interfolder comprising:

a first feeder means for continuously feeding said first web of material;

a second feeder means for continuously feeding said second web of material;

a first transverse cutting means for cutting sections of toweling of equal length from said first web of material;

a second transverse cutting means for cutting sections of toweling of equal length from said second web of material;

a first extraction means for separating said sections of toweling cut from said first web to a specified length in the direction of advancement;

a second extraction means for separating said sections of toweling cut from said second web to a specified length in the direction of advancement;

reconducting means for reconducting the sections of toweling cut from said first and second webs;

staggering means for ordering said cut sections of toweling cut from said first and second webs in a first sequence having an equal and adjustable overlap;

wherein said staggering means comprises:

a staggering roller having an outer lining and formed of a plurality of coaxial, wheel shaped staggering discs in a torsion-free position on a common shaft;

a counter roller which forms a common parallel roller gap with the outer lining of the staggering roller; and a plurality of staggering cylinders which are pressed against the counter roller of the staggering means in the roller gap and which extend into the periphery of said staggering roller; and a pair of counter rotating folding rollers and a packing track for continuously folding the cut sections of toweling of said first sequence in a zigzag manner into a folded stack.

10. The interfolder according to claim 9, wherein the counter roller of said staggering means is driven at a peripheral speed which, as a function of the overlapping of the cut sections of toweling, is slower than the peripheral speed of said staggering roller.

11. The interfolder according to claim 10, wherein said plurality of staggering cylinders are driven at the same peripheral speed as the counter roller of the staggering means.

12. The interfolder according to claim 11, wherein each staggering cylinder is driven by a drive belt having a back side thereof serving as a graduated surface.

13. The interfolder according to claim 10, wherein the counter roller of the staggering means is driven by at least one belt having a back side serving as a graduated surface.

14. The interfolder according to claim 9, wherein said first and second extraction means each comprises an extraction roller having vacuum gripper devices and a segment roller which acts together with said extraction roller.

15. The interfolder according to claim 14, wherein the extraction roller of the first extraction means is in conveying contact with the staggering roller of the staggering means and forms together with the staggering roller and the extraction roller of the second extraction means a common roller gap and the extraction roller of the first extraction means is configured as a reconducting roller for the sections of toweling cut from the first and second webs and, for this purpose, has additional vacuum gripper devices.

16. The interfolder according to claim 15, wherein the distance measured in circular measurement on the outer lining of the staggering roller is greater than between the roller gap, of the staggering roller and the extraction roller of the first extraction means, and the roller gap, of the staggering roller and the counter roller of the staggering means, than the largest length of a cut section of toweling.

17. The interfolder according to claim 16, wherein the roller gap of the staggering roller and the counter roller of the staggering means is located in a direction of rotation of the staggering roller behind its lowest point.

18. The interfolder according to claim 9, wherein each said staggering disc includes at least one vacuum gripper device which can be pressurized with regulated vacuum, which device is arranged in a flattening of the outer casing of the disc and the flattening, viewed in the direction of rotation of the staggering roller, terminates at a gradation.

19. The interfolder according to claim 18, wherein the gradations and the flattenings of the plurality of staggering discs lie in a row and are aligned parallel to the common shaft of the discs.

20. The interfolder according to claim 18, which further includes at least one compressed air jet located in the outer casing of each staggering disc in the direction of rotation in front of the gradation, which can be pressurized with regulated compressed air.

21. The interfolder according to claim 9, wherein said staggering cylinders, said first and second extraction means, said staggering roller, the counter roller of the staggering means, and said pair of folding rollers can be driven at the same peripheral speed.

* * * * *